United States Patent [19]

Shepley, Jr.

[11] 4,103,667

[45] Aug. 1, 1978

[54] BOW STRING MOUNTING AND TENSIONING BRACKETS

[76] Inventor: Paul E. Shepley, Jr., Rte. 1, Mahomet, Ill. 61853

[21] Appl. No.: 792,880

[22] Filed: May 2, 1977

Related U.S. Application Data

[63] Continuation of Ser. No. 541,718, Jan. 17, 1975, abandoned.

[51] Int. Cl.[2] ..... F41B 5/00

[52] U.S. Cl. ..... 124/24 R; 124/88

[58] Field of Search ..... 124/23 R, 24 R, 89, 124/86, 90

[56] References Cited

U.S. PATENT DOCUMENTS

| | | | |
|---|---|---|---|
| 3,812,835 | 5/1974 | Smith | 124/24 R |
| 3,841,295 | 10/1974 | Hunter | 124/24 R |
| 3,841,295 | 10/1974 | Hunter | 124/24 R |
| 3,854,467 | 12/1974 | Hofmeister | 124/90 X |
| 4,005,696 | 2/1977 | Jennings | 124/24 R |

OTHER PUBLICATIONS

"Precision" - Precision Shooting Equipment, "Archery" Magazine, p. 47, May 1974.

"Arrowstar" Model of Jennings Compound Bow Inc., from: "Archery" Magazine, p. 18, Oct. 1976.

Ben Pearson Compound Model 250, From: "Archery" Magazine, pp. 32, 33, Aug. 1975.

*Primary Examiner*—William R. Browne

*Attorney, Agent, or Firm*—Jack E. Dominik

[57] ABSTRACT

There is disclosed speed brackets for use on a compound bow which is formed by a pair of limbs mounted at the interior ends thereof to a handle section, comprising a pair of mount brackets carried on the bow handle section adjacent the opposed ends thereof and extending laterally inwardly in the direction of the intermediate stretch of the bow string, the inward ends of each of the mount brackets contacting the bow string thereby to form a tensioning point for the bow string at a point spaced from each of the limbs and positioned between the limbs and the intermediate stretch of the bow string.

5 Claims, 6 Drawing Figures

FIG. 1
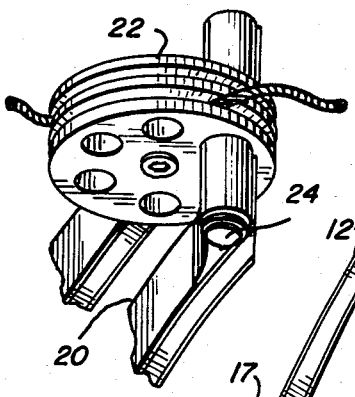
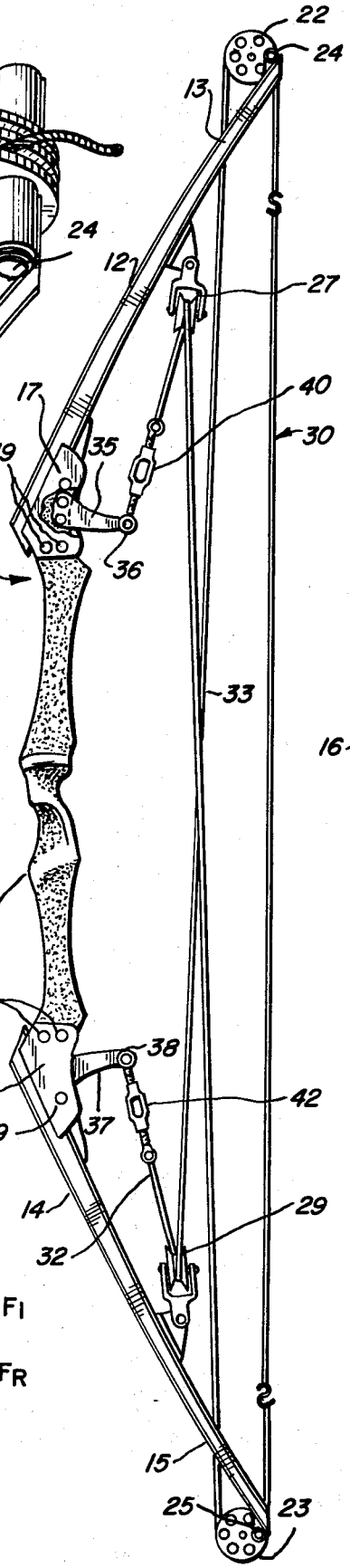
FIG. 2
FIG. 3
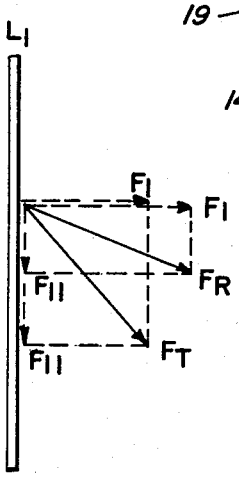
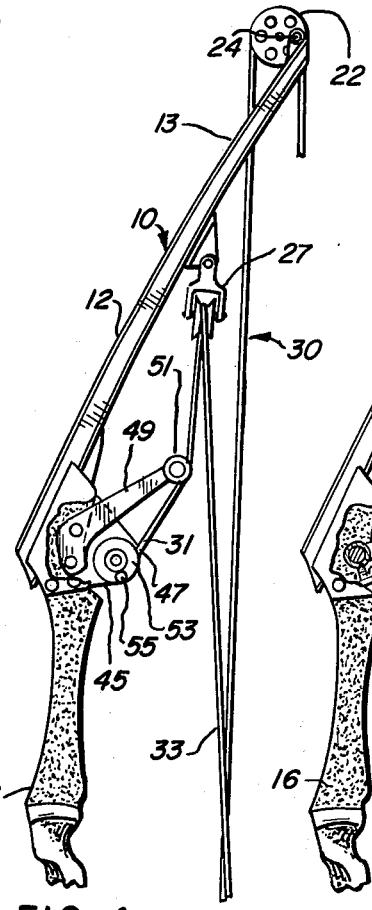
FIG. 4
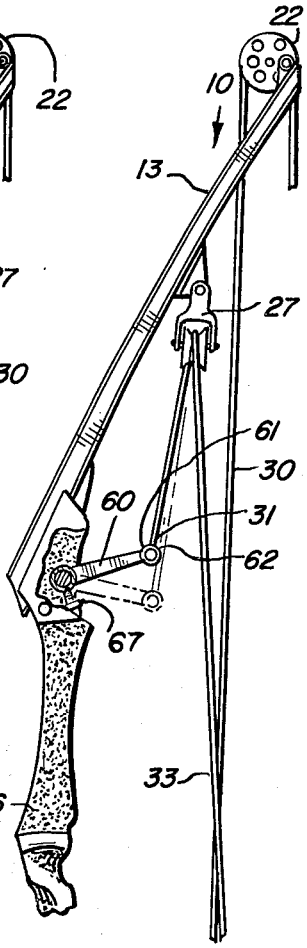
FIG. 5
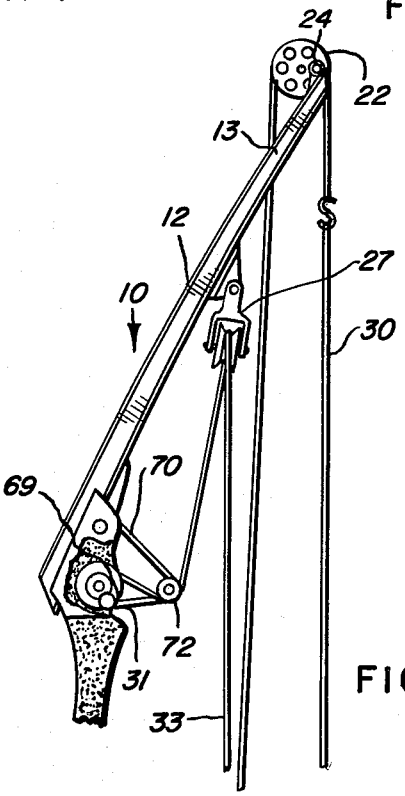
FIG. 6

BOW STRING MOUNTING AND TENSIONING BRACKETS

This is a continuation of application Ser. No. 541,718 filed Jan. 17, 1975, now abandoned.

BACKGROUND OF THE INVENTION

The art of archery has progressed to a point where sophisticated archery equipment is now available and in use for a variety of functions. Generally, compound bows are formed by a pair of bow limbs which are joined at their inner ends to a handle section. The outer ends of the limbs are bifurcated and are provided with an eccentric pulley mounted in the bifurcated portion thereof. In the compound bows presently available, one end of the bow string is mounted to the interior surface of one of the bow limbs, and is then carried around a first idler wheel positioned between the mount point of the bow string on the limb and the outer end of the limb, and is then carried about the opposed eccentric pulley mounted on the opposed bow limb end, crossed back over the opposed eccentric pulley mounted on the opposed limb end, thence down around a second idler wheel such that the opposed end of the bow string is then mounted to the interior surface of the second bow limb at a mount point positioned between the junction of the bow limb with the handle section and the second idler wheel. It should be understood that where reference is made to the mounting of the bow string to the interior surface of the bow limbs, it will be understood that such mounting may be either to the bow limbs or the handle section or a combination of both. In addition, where reference is made to a bow string, it should be understood that this phrase applies equally to a cable arrangement or a combination of bow cables and bow strings.

The primary function and advantage achieved by a compound bow is to increase the arrow speed and impact by providing a bow which, for a given holding strength, is capable of storing greater energy when drawn to the full draw of the bow. The provision of opposed offset pulleys mounted in the bifurcated ends of the bow limbs has the effect of providing a lesser pull weight at full draw than is required to pull the bow string through an intermediate drawn position. Another advantage which follows is that the force applied by the archer to draw the bow string through the intermediate drawn position is greater than the force required to hold the bow string in the fully drawn position such that it is possible for the archer to maintain the bowstring in the drawn position without exerting the same great degree of force. Exemplary of a prior art patent which illustrates a compound bow is U.S. Pat. No. 3,486,495.

In understanding further improvements related to compound bows, it is also necessary to appreciate the fact that the forces causing the flexing/bending of the compound bow occur at two major points on each limb; one of the points is at the tip end of each of the limbs where the eccentric wheel is positioned, and the other is at a point further down the limb where the idler wheel is attached to the bow limb. In presently existing compound bows, and as indicated previously, the ends of the bow strings are attached to the interior surfaces of each of the bow limbs. However, it is known that the force incident to the idler wheel is a major source of the mechanical advantage which makes a compound bow superior to a regular bow. Hence while the force at the tips of the bow limbs is relatively constant, it is the force of the idler wheels which effect the efficiency, control, and ultimately, the thrust on the bowstring and ultimately the arrow. The foregoing results from the fact that the direction of the force applied to the limb at the idler wheel lies primarily along the direction of the cable or bowstring from the idler wheel to the point where the bowstring attaches to the handle or bow limb. It will therefore be appreciated that if the bowstring is attached to the interior surface of the bow limbs, the perpendicular force is less and the parallel force is greater thus affecting the efficiency, control, and velocity incident to the thrust of the bowstring when released.

OBJECTS AND ADVANTAGES

The present invention, therefore, seeks to further improve upon the construction of the compound bow by providing a structure which increases the perpendicular force incident to the bowstring and ultimately the arrow, making these forces more efficient and more controllable, which in turn, permits other improvements to be made to the compound bow.

More specifically, the principal object of the present invention is to provide a pair of mount means positioned one each interiorly of the bow limbs and positioned between the corresponding idler wheel on the handle section to provide mounting points for the bowstring ends at a point spaced inwardly from the interior surfaces of the bow limbs.

In connection with the foregoing object, it is another object of this invention to provide a construction for a compound bow of the type described including mount brackets providing mount points for the bowstring at positions spaced inwardly from the interior surfaces of the bow limbs such that the perpendicular force incident to the bowstring is increased while the parallel forces are decreased resulting in a more efficient, controllable, and ultimately greater thrust on the bowstring when released.

Still in connection with the foregoing objects, it is another object of this invention to provide a compound bow construction of the type described wherein the provision of mount brackets for mounting the ends of the bowstring at a point spaced inwardly from the interior surfaces of the bow limbs thereby permits the use of a lighter, thinner, bow limb while still permitting the same amount of energy/thrust force to be obtained as one would achieve with a heavier and thicker limb under the same conditions. In effect, the use of a lighter and thinner limb having a greater bend ability, and less mass, inertia, and hysteresis loss to overcome, permits faster unflexing, quicker acceleration, and ultimately imparts more velocity to the bow string and ultimately the arrow.

A further object of the invention is to provide a compound bow construction which further includes a pair of mount brackets mounted on the interior surfaces of the bow limbs or handle and extending laterally inwardly for a distance thereby to provide a mount point for the ends of the bow string between the corresponding idler wheel and the handle section such that the ends of the bow strings are attached at a point spaced from each of the bow limbs to accomplish the foregoing purposes.

In connection with the foregoing object, it is another object of this invention to provide a compound bow structure having mount brackets of the type described wherein the mount brackets are pivotably mounted to each of the corresponding bow limbs and are provided with stop means for arresting the pivotable movement of the mount bracket in any desired disposition.

A further object of this invention is to provide a compound bow structure of the type described wherein another embodiment of the subject mount bracket provides a mount plate mounted on each of the bow limbs and extending laterally inwardly for a distance and providing a mount point for the ends of the bow strings, and further including a tension bracket mounted on each of the mount plates and extending laterally inwardly therefrom and contacting the bow strings at a point between the mount point of the end of the bow string to the mount plate and the idler wheel thereby to place tension against the inner stretch of the bow string.

Further features of the invention pertain to the particular arrangement of the elements and parts whereby the above-outlined and additional operating features are attained.

The invention, both as to its organization and method of operation, together with further objects and advantages thereof, will best be understood by reference to the following specification, taken in connection with the accompanying drawings in which:

GENERAL DESCRIPTION OF DRAWINGS

FIG. 1 is a perspective view showing the outer end of one of the bow limbs illustrating the bifurcated portion thereof and the eccentric pulley mounted thereon;

FIG. 2 is a side elevational view illustrating the subject compound bow of the present invention including the mount bracket positioned thereon providing a mount point for the ends of the bow strings intermediate the bow limbs and the intermediate stretch of the bow string;

FIG. 3 is a graph showing the difference in force vectors incident to the archery bow construction of the present invention as compared to the prior art archery compound bows;

FIG. 4 is a side elevational view, partly broken away showing another embodiment of mount brackets incident to the present invention;

FIG. 5 is a side elevational view, partly broken away, showing still another embodiment of the subject mount brackets incident to the present invention; and FIG. 6 is a side elevational view, partly broken away, illustrating still another embodiment of the mount brackets incident to the present invention.

SUMMARY OF INVENTION

The present invention is designed to improve upon presently existing compound archery bows by providing a pair of mount means consisting of mount brackets, mounted on the interior surfaces of the bow limbs and extending laterally inwardly for a distance to provide mount points for the ends of the bow strings intermediate the bow limbs and the intermediate stretch of the bowstring. The intent of the provision of the subject mount brackets is to increase the perpendicular force vector incident to the bending of the limbs during the pull of the bow string, and thereby to decrease the parallel force vectors such that a more efficient and controllable perpendicular force vector is achieved which ultimately results in greater thrust upon release of the bowstring and hence, greater thrust of the arrow when released.

As illustrated in the alternative embodiments shown in FIGS. 4 through 6 of the drawings, the subject mount brackets may assume various configurations, the importance of the mount brackets residing in the fact that the bowstring is essentially mounted and/or tensioned at a point spaced inwardly from the interior surfaces of the bow limbs thereby to permit the advantageous forces to result when the bow limbs are flexed as the bowstring is drawn to a full draw.

DETAILED DESCRIPTION OF DRAWINGS

With reference to FIG. 2 of the drawings, a compound bow 10 is illustrated. As shown, the compound bow 10 is formed by a pair of limbs 12 and 14 joined to a handle section 16 by any appropriate means such as junction plates 17 and 18 respectively which are fastened thereto by means of screws 19. The outer ends 13 and 15 of the respective bow limbs 12 and 14 are bifurcated as generally illustrated by the numeral 20 (FIG. 1), and each of the bifurcated ends 13 and 15 carry an eccentric pulley 22 and 23 respectively mounted in the open channel formed in the bifurcation, by means of pins 24 and 25.

The interior surfaces of the respective bow limbs 12 and 14 are shown to be further provided with idler wheels 27 and 29 which are mounted substantially intermediate between the outer ends 13 and 15 respectively of the limbs 12 and 14, and the junction plates 17 and 18 respectively. As further shown in FIG. 2, the bowstring 30 includes ends 31 and 32 respectively, and the manner in which the bowstring 30 is carried on the compound bow 10 is illustrated in FIG. 2. It will be observed that the bowstring 30 commences at end 31, and then circumscribes the first idler wheel 27, thence extends downwardly to circumscribe and be positioned within the eccentric pulley 23 carried by the outer end 15 of the bow limb 14, and then upwardly and circumscribed and positioned within the outer eccentric pulley 22 carried by the opposed bow limb 13, thence downwardly and around the second idler wheel 29 and terminating at the opposed end 32.

As indicated previously, the prior art compound bows presently available have the mount points for the ends of the bowstring 31 and 32 positioned on the interior surfaces of the bow limbs 12 and 14. As is observed in FIGS. 2, 4, 5, and 6 of the drawings, the present invention provides alternative mount points.

With specific reference to FIG. 2 of the drawings, it will be noted that a pair of mount brackets 35 and 37 are mounted to the respective bow limbs 12 and 14, at a point adjacent to the point of junction of the bow limbs 12 and 14 with the handle section 16. Each of the mount brackets 35 and 37 extend laterally inwardly in a direction between the bow limbs 12 and 14 and the intermediate stretch of the bowstring represented by the numeral 33. In this particular embodiment, the mount brackets 35 and 37 take the form of arms terminating at an inward end 36 and 38 respectively, and carry turnbuckles 40 and 42 thereon. The respective ends 31 and 32 of the bowstring 30 are fixedly secured to the outer ends of the turnbuckles 40 and 42 respectively thereby to complete the structure.

It will therefore be appreciated that the compound bow structure as illustrated in FIG. 2 of the drawings provides mount brackets which mount the ends 31 and 32 of the bowstring 30 at a point spaced inwardly from the interior surfaces of the bow limbs 12 and 14 respectively. As has been indicated hereinabove, the prior art compound bows mount the ends of the bowstring 31 and 32 directly to the interior surfaces of the bow limbs 12 and 14. With reference to FIG. 3 of the drawings, the differences in the force vectors incident to such presently existing prior art compound bows as compared with the force vectors incident to the compound bows of the present invention including the mount brackets is illustrated. The force vectors identified as $F_I$ relate to the perpendicular force vector while the designation $F_{II}$ relate to the parallel force vectors. The designations $F_t$ and $F_r$ relate to the total force vectors and are dependent upon the point of attachment of the bowstring to the bow limbs. It will be appreciated that the most important of a theoretically infinite number of component parts of the force vectors are the force vector perpendicular to the limb which is the most efficient, and the force vector in a direction parallel to the limb which is the least efficient since this force vector would tend to collapse the limb on itself producing no bend at all. In representing these force vectors graphically as the same relate to the total force vector, the two subvectors, in the parallel and perpendicular direction are drawn and extended to a point perpendicular to the end point of the total force vector $F_t$ and $F_r$ respectively. It will therefore be observed that where the bowstring is attached directly to the bow limbs, such that the total force achieved is represented by vector $F_p$, the force vector representing the perpendicular force $F_I$ is shorter while the force vector representing the parallel force $F_{II}$ is longer. As has been indicated previously, it is more desirable to have the perpendicular force greater than the parallel force which will increase the ease of limb bending as well as to produce a more efficient control of the forces and ultimately result in better bowstring thrust and arrow thrust upon release. It is further shown that by using the mount brackets of the present invention such that the mount points of the ends of the bowstring are positioned intermediate between the bow limbs and the intermediate stretch of the bowstring the total force vector represented by the designation $F_r$ results in component subvectors $F_I$ and $F_{II}$ such that the perpendicular force vector $F_I$ is increased while the parallel force vector $F_{II}$ is decreased such that the resultant force is more efficient and easier to control. It will therefore be appreciated that the provision of the mount brackets effectively changes the vector angle resulting in an increase in the efficient perpendicular force while at the same time decreasing the wasted parallel force incident to the flexing and unflexing of the bow limbs.

In FIGS. 4 through 6 of the drawings, alternative embodiments are illustrated for accomplishing the same desired result.

With specific reference to FIG. 4 of the drawings, and in describing the same, like reference numerals will be utilized to refer to like parts relative to FIG. 2 of the drawings. The bow 10 illustrated therein is, once again, provided with a bow limb 12 joined to a handle section 16. The outer end 13 of the limb 12 is provided with an eccentric pulley 22 mounted by a pin 24. It will further be observed that in this embodiment, a mount plate 45 is mounted on the bow limb adjacent to the point of juncture of the bow limb 12 with respect to the handle section 16. The mount plate 45 provides a mount point 47 for mounting the end of the bowstring 31 thereto. It will be observed that the mount point 47 is positioned interiorly with respect to the bow limb 12 and intermediate the bow limb 12 in the intermediate stretch of the bowstring represented by the numeral 33. In addition, it will be observed that a tension arm 49 is carried on the mount plate 45 and extends laterally inwardly and provided with a roller wheel 51 at the end thereof. The roller wheel 51 contacts the bow string at a point between the mount point 47 and the idler wheel 27 effectively accomplishes the same result as the mount bracket 35 with respect to FIG. 2 of the drawings.

In addition, the mount point 47 may take the form of a take-up wheel 53 with any appropriate lock mechanism 55 provided to lock the take-up wheel 53 in any desired position. In this manner, any additional slack of the bow string 30 may be taken up by the take-up wheel 53 while the tension arm 49 continues to apply tension to the bow string 30 at a point positioned between the take-up wheel 53 and the idler wheel 27.

In FIG. 5 of the drawings, still another alternative embodiment is illustrated which again accomplishes the same result as indicated with respect to the compound bow of FIGS. 2 and 4. Once again, the compound bow 10 includes bow limb 12 joined to handle section 16 in the manner illustrated previously. The upper end 13 of the limb 12 is provided with the eccentric pulley 22 about which the bowstring 30 is mounted. The bow limb 12 is provided with a bracket arm 60 which is mounted to the bow limb 12 and extends laterally inwardly in the direction of the intermediate stretch of the bowstring represented by the numeral 33. The inner end 61 of the bracket arm 60 provides a mount point 62 for mounting the inner end 31 of the bow string thereon.

In this particular embodiment, the outer end 63 of the bracket arm 60 is set in a channel 65 provided in the bow limb 12 or handle section 16 as the case may be, and is permitted to reciprocate slightly therein. In effect, this construction allows the bracket arm 60 to pivot within a defined arc, the particular setting of the bracket arm 60 in any desired arcuate setting being accomplished by set-screw 67. As illustrated in FIG. 5 of the drawings, by the phantom lines, the bracket arm 60 may be moved into a downward position which accomplishes the function of providing further tension on the bowstring 30 as well as to adjust the draw length and to provide a means to balance the eccentric wheel timing thereby further increasing the efficiency factor and rendering even greater control to the archer when utilizing the subject bow.

FIG. 6 of the drawings illustrates still another alternative embodiment for a compound bow 10 which includes a bow limb 12 having an outer end 13 provided with an eccentric pulley 22 carried by a pin 24. In this particular instance, the mount point 69 for the end 31 of the bowstring 30 is carried effectively on the bow limb 12 but wherein a bracket arm 70 is further provided, the same being mounted on the bow limb 12 and extending laterally inwardly for a distance to contact the bowstring 30. The point at which the bracket arm 70 contacts the bowstring 30 is the effective mount point since this is the angle relationship established with respect to the idler wheel 27. It will further be noted that in this embodiment, a roller wheel 72 is provided at the point of contact of the bracket arm 70 with the bowstring 30 to facilitate the movement of the bowstring 30 during the full draw and release thereof.

As has been indicated previously, the provision of mount brackets of the type described in connection with the various figures of the drawings clearly have an advantageous effect on the perpendicular force vectors that operate in connection with the draw of the bow and the release thereof, and consequently, have an impact on the thrust of the bowstring as well as the arrow. As was also previously pointed out, in view of the fact that the provision of bracket arms or speed brackets permit a more efficient flexing of the limbs as regards the force required, the same also increase the efficient control of the bow. This is accomplished since the provision of speed brackets requires less total force to be applied to flex the bow while at the same time permitting a greater amount of the total force to be transferred into the perpendicular component of the force vector. While this does not in and of itself add any speed or velocity to the arrow, nevertheless, a higher velocity is attainable because a more efficient force is easier to control. In effect, the speed brackets permit a lower but more efficient total force to be applied in order to produce the same amount of flexing force on the limbs and due to the lower flexing force necessary, the overall force required to flex is easier to regulate and therefore the archer can be more precise.

In addition, better control over the flexing of the bow also permits the limbs to be stretched to a greater degree. In other words, the archer is permitted to put more tension/energy into the bow limbs and still keep the bow in balance. Furthermore, since the parallel component of the force vectors has been reduced, there is less likelihood of damaging the limbs which do have the inate tendency to crack upon the flexing. This feature becomes crucial in compound bows which include idler wheels because these wheels are esential in maintaining an overall balance for the bow. One of the major functions of the idler wheels and the cross cable arrangement is to provide an automatic, tough adjustable, feedback or control circuit which tends to equalize the tension on each bow limb and its corresponding eccentric pulley. This balance is absolutely necessary since if the limbs are out of balance, one will throw harder or slightly ahead of the other on release putting a torque on the arrow out of the line of flight and causing it to wobble.

In effect, greater arrow velocity is achieved because a greater degree of control over the forces applicable to the bow can be attained, and the bow limbs may be flexed more efficiently, and more stress/energy can be put into the bow limbs, and all of these factors result in the possibility of using a lighter, thinner limb while still obtaining as much energy/thrust out of the bow as one would be able to obtain with a heavier thicker limb under normal conditions. Thus, when the bow is released and the limbs begin to unflex, the lighter, thinner limbs, having a greater bend and less mass, inertia, and hysteresis loss to overcome, especially in the crucial first instant, unflex faster, accelerate quicker, and impart more velocity to the string and the arrow.

Another advantage to be obtained is that due to the greater degree of control permitted by the use of the brackets as described above, the bow may be strung tighter with less slack in the bowstring. The resulting benefit is that more energy may be built into the first few inches as the bow as drawn.

It will also be apparent that the length of the mount brackets extending inwardly in the direction of the intermediate stretch of the bowstring may be varied to some extent. It has been found that the advantage gained as the mount brackets change the cable angle is a mathematically exponential function, which means that the first few increments of change produce a proportionately much greater amount of desired effect then do the later increments of change. While it may seem more desirable to have the mount brackets extend laterally inwardly for a distance such that the same are in vertical alignment with the idler wheels, it has been found that to extend the mount brackets to this point generally interferes with the cross cable arrangement of the bowstring, and greatly increases the possibility that the mount brackets will be struck by the bowstring as it passes the center point on release. This possibility is eliminated by utilizing an off-set bracket such that one can obtain the most efficient arrangement wherein the inward end of the bracket is in vertical alignment with the idler wheel.

It will be appreciated that there has been provided by virtue of this invention, an improved compound bow structure which permits more efficient utilization of the force vectors incident to archery bows, further permits easier control of the bow, while at the same time permitting the use of a lighter and thinner bow limb in the structure of the bow. In addition, the subject mount brackets of the present invention produce a compound bow wherein upon release of the bow after a full draw, a greater thrust energy is achieved in the bowstring and hence in the arrow.

While there has been described what is at present considered to be the preferred embodiments of the invention, it will be understood that various modifications may be made therein and it is intended to cover in the appended claims all such modifications as fall within the true spirit and scope of the invention.

What is claimed is:

1. In an archery bow of the type having a pair of resilient bow limbs joined to a handle section, each of the bow limbs provided with a bifurcated outer end and having an eccentric pulley mounted within the bifurcated end, each of the bow limbs further provided with an idler wheel mounted interiorly thereof and spaced inwardly from the corresponding eccentric pulley, a bow string having opposed ends and having a central stretch portion carried between the ends of the pair of bow limbs and circumscribing the essentric pulleys, and the opposed ends having a portion of one of the opposed ends of the bow string circumscribed thereabout and terminating at an inner end adapted for mounting to the archery bow, the improvement comprising in combination, mount means provided on said archery bow, to provide a mount for the inner ends of the bow string, said mount means comprising a pair of bracket arms, one of each of said bracket arms mounted on the opposed end of said handle section and positioned intermediate the corresponding idler wheel and handle section and extending laterally inwardly for a distance to an inward end, the inward end of each of said bracket arms forming the sole and only point of attachment and anchoring of a corresponding inner end of the bow string such that the bow string end emmanating from the idler wheel is anchored to the said corresponding bracket arm thereby to insure that the inner end of the bow string avoids contact with the bow limbs and all other portions of said archery bow at all points excepting said bracket arm, each of said bracket arms further positioned and arranged to form a tensioning point for the bow string at a point spaced between each of the bow limbs and the intermediate stretch of the bow string, said bracket inner end being secured to anchor the bow string at a point spaced from the handle end, said bracket inner end being spaced from said handle a sufficient distance to define a vectoral force component perpendicular to the limb greater than that when the bowstring is attached at the bracket attachment to the handle while simultaneously reducing the corresponding parallel force component along the limb, whereby a larger portion of the potential energy prior to release is directed perpendicularly to the flexed limb and the parallel component is reduced.

2. The archery bow as set forth in claim 1 above, wherein each of the said bracket arms is further provided with rotatable adjustment means mounted on the inward end thereof and interposed between said inward end of said bracket arm and said inner end of the corresponding bow string, whereby the inner end of the bow string is mounted on said adjustment means as the sole and only point of attachment and anchoring, while in turn, said adjustment means permits the tensional forces on the bow string to be adjusted.

3. The archery bow as set forth in claim 2 above, wherein said adjustment means comprises a turn buckle having one end thereof fixedly secured on said bracket arm, and the other end thereof forming the sole and only anchoring point for a corresponding inner end of said bow string.

4. In the archery bow of claim 1, said bracket inner end being spaced from said handle a sufficient distance to define a perpendicular vector greater than the parallel vector exerted on the limb at the idler wheel.

5. In the archery bow of claim 1, said bracket being pivotal and selectively positionable at its outer end where secured to the handle, whereby the perpendicular vector on the limb at the idler pulley can be adjusted by selectively positioning the inner end of the bracket.

* * * * *